US006308117B1

(12) United States Patent
Ryland et al.

(10) Patent No.: US 6,308,117 B1
(45) Date of Patent: Oct. 23, 2001

(54) INTERLOCKING FOR A RAILWAY SYSTEM

(75) Inventors: Henry Archer Ryland, Swainswick; Timothy John Molloy, Bradford on Avon; Mark Tremlett, Calne, all of (GB)

(73) Assignee: Westinghouse Brake & Signal Holdings Ltd. (GB)

( * ) Notice: Subject to any disclaimer, the term of this patent is extended or adjusted under 35 U.S.C. 154(b) by 0 days.

(21) Appl. No.: 09/528,121

(22) Filed: Mar. 17, 2000

(30) Foreign Application Priority Data

Mar. 17, 1999 (GB) ..... 9906137

(51) Int. Cl.[7] ..... B61L 19/06
(52) U.S. Cl. ..... 701/19; 701/117; 246/131
(58) Field of Search ..... 701/117, 19, 20; 246/131

(56) References Cited

U.S. PATENT DOCUMENTS 3,868,641 * 2/1975 Hagelin ..... 340/163
4,305,556 * 12/1981 Norton et al. ..... 246/5
4,517,673 * 5/1985 Brown et al. ..... 371/36
4,641,243 2/1987 Hartkoph et al. ..... 701/117
4,763,267 * 8/1988 Knight et al. ..... 701/117
4,967,347 * 10/1990 Smith et al. ..... 364/200
5,339,237 * 8/1994 Mody et al. ..... 364/184
5,504,860 * 4/1996 George et al. ..... 395/182.09
6,154,735 * 11/2000 Crone ..... 706/45

FOREIGN PATENT DOCUMENTS 4306470 4/1993 (DE) .
0120339 10/1984 (EP) .
0503336 9/1992 (EP) .
0558204 8/1995 (EP) .

* cited by examiner

*Primary Examiner*—Tan Nguyen
(74) *Attorney, Agent, or Firm*—Lee, Mann, Smith, McWilliams, Sweeney & Ohlson

(57) ABSTRACT

An interlocking for a railway system, comprises first, control computing means (2) which commands route settings in the system and second, protection computing means (3) coupled with the first computing means (2) and which allows commands from the first computing means (2) to be brought into effect or otherwise in dependence on the state of the railway system.

8 Claims, 2 Drawing Sheets

INTERLOCKING FOR A RAILWAY SYSTEM

The present invention relates to an interlocking for a railway system.

According to the present invention, there is provided an interlocking for a railway system, comprising first, control computing means which commands route settings in the system and second, protection computing means coupled with the first computing means and which allows commands from the first computing means to be brought into effect or otherwise in dependence on the state of the railway system.

The interlocking may include interface means, which interfaces with trackside equipment of the system, and a communication path between the interface means and the first and second computing means.

Preferably, the first and second computing means have different designs to reduce the risk of common mode failures.

Preferably, the second computing means receives information concerning the state off the railway system and information concerning commands from the first computing means and only allows a command from the first computing means to be brought into effect if the current state of the railway system is such that it would be safe in do so. In this case, if a command is not allowed to be brought into effect, the second computing means preferably causes the railway system to be put into a safe or more restrictive state. The second computing means could monitor commands from the first computing means and issue a complementary command to allow a command from the first computing means to be brought into effect if it is safe to do so. Alternatively, the second computing means could monitor commands from the first computing means and if such a command (which could be in two complementary versions) is not to be brought into effect, the second computing means issues a negating command for that purpose.

There may be at least one further such fist computing means, the or each further such first computing means being coupled with a respective such second computing means and means for switching operation from one of the first and second computing means arrangements to the other or another of the first and second computing means arrangements.

Figure 1:
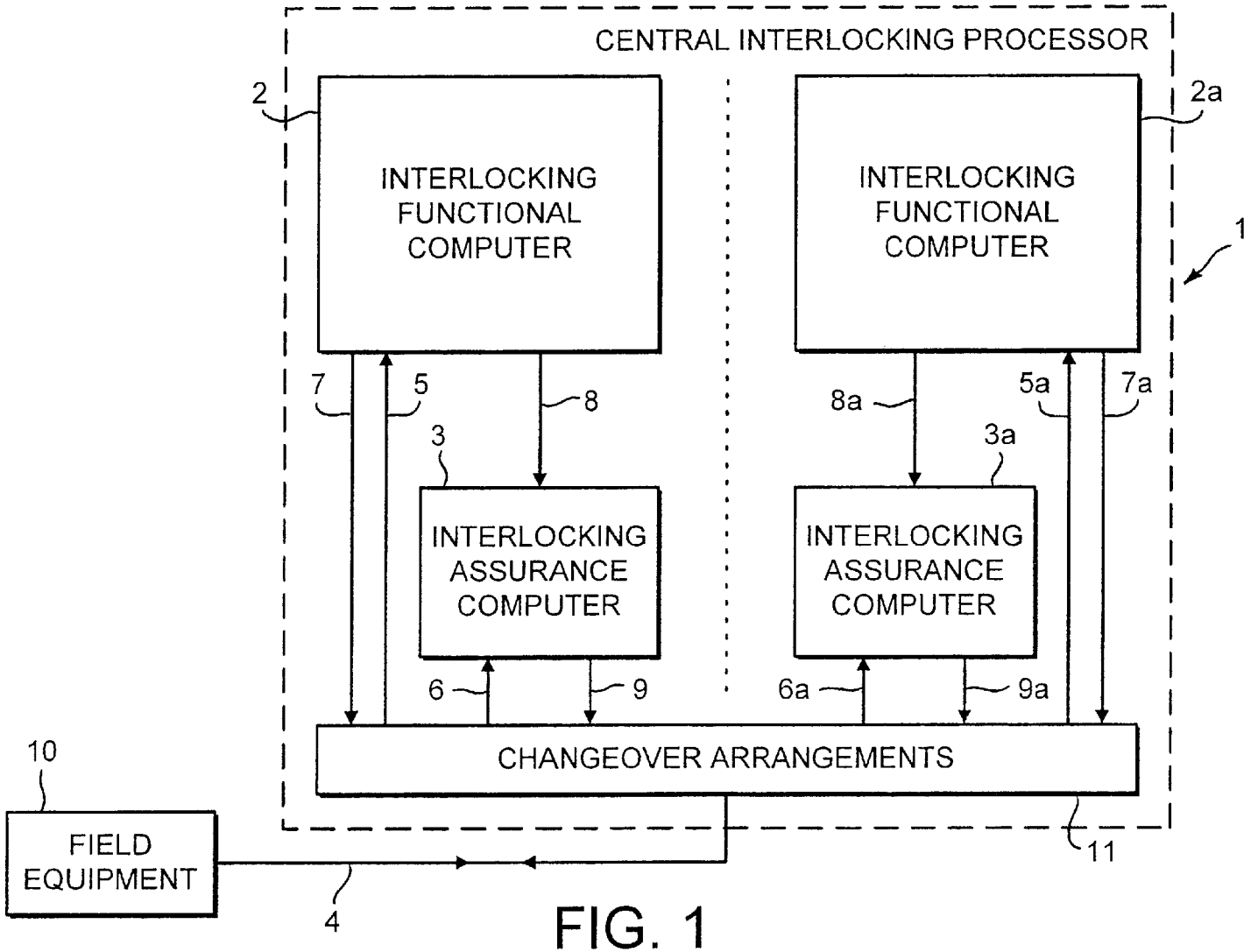
Figure 2:
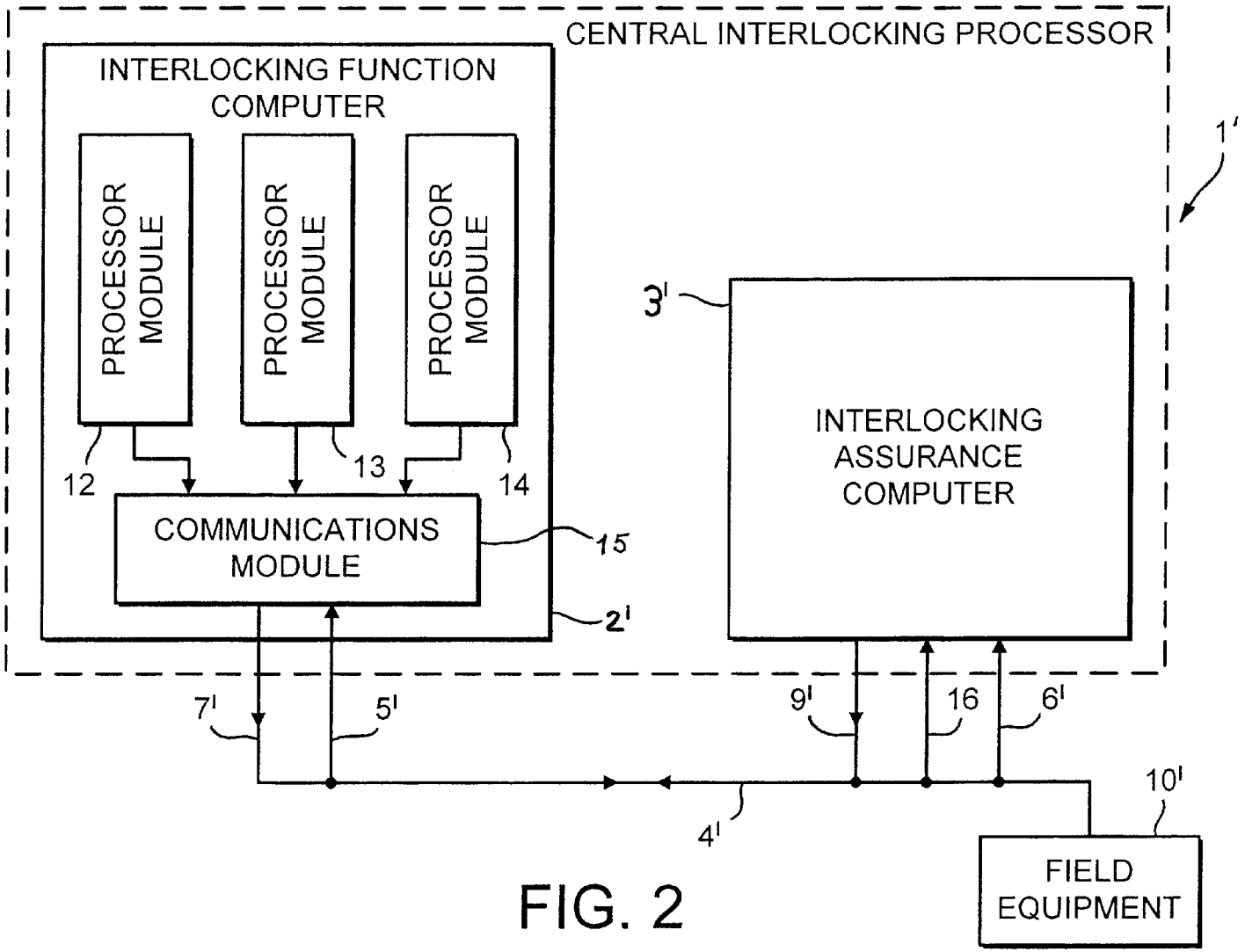

The present invention will now be described, by way of example, with reference to the accompanying drawings in which:

FIG. 1 is a schematic diagram of a first example of an interlocking according to the present invention; and FIG. 2 is a schematic diagram of a second example of an interlocking according to the present invention.

The interlocking systems to be described each comprises 3 parts:

1. A central interlocking processor.
2. A set of field equipment which provides the interface between the central interlocking processor and trackside equipment (such as points machines, signal lamps, automatic warning system (AWS) magnets, automatic train protection (ATP) equipment, etc).
3. A high speed serial communications path between the central interlocking processor and the field equipment.

Important aspects of each of the systems are:

1. Separation of control (functional) and protection (assurance) functions within the central interlocking processor.
2. Diversity of design of the functional and assurance aspects, reducing the risk of common mode failures.

In the first example, there is also separation of functional and assurance telegrams from the central interlocking processor to the field equipment.

Referring to FIG. 1, a central interlocking processor 1 contains two separate, diverse, and non-divergent computers in series with one another. The architecture of the central interlocking processor is similar to the architecture of a mechanical lever frame.

The first computer, an interlocking functional computer 2, which can be configured using familiar data structures, e.g. solid state interlocking (SSI) data, ladder logic or a representation of the signalling control tables, carries out a conventional interlocking function. The interlocking functional computer 2 performs the role of the signalman and levers in a mechanical lever frame.

The second computer, an interlocking assurance computer 3, is a rule based computer which contains the signalling principles for the particular railway system where the interlocking is applied. The interlocking assurance computer 3 performs the role of the locks in a mechanical lever frame. There are three levels of rules contained within the interlocking assurance computer 3. The lowest level comprises fundamental rules which must be true for all railway authorities, e.g. the interlocking must not command a set of points to move when a track section through a set of points is occupied by a train. The second level comprises the signalling principles specified by the railway authority and are common to all installations for that railway authority. The third level represents the topological arrangement of the equipment in the railway system, for example expressing the relationship between a signal and the set of points it is protecting.

The central interlocking processor 1 may contain one or two interlocking assurance computers 3 depending on the degree of diversity required by the railway authority.

Reference numeral 4 designates a high speed serial communications path between the central interlocking processor 1 and a set of field equipment 10 which provides the interface between the central interlocking processor 1 and trackside equipment such as points machines, signal lamps, AWS magnets and ATP equipment.

Both computers 2 and 3 receive telegrams reporting the status of the trackside equipment from the field equipment via the path 4 and paths 5 and 6 respectively.

The interlocking functional computer 2 processes route setting requests from the signaling control arrangement of the railway system and applies its data to determine whether or not to set the route. If the interlocking functional computer 2 decides not to set the route, no further action is taken. If the interlocking functional computer 2 decides to set the route, it initiates a telegram via a path 7 to the field equipment 10 commanding the field equipment to set up the route (by moving sets of points and clearing the signal for example) and also forwards the telegram to the interlocking assurance computer 3 via a path 8.

The interlocking assurance computer 3 examines telegrams received from the interlocking functional computer 2 to determine whether the actions commanded in the telegram are safe given the current state of the railway system. If the interlocking assurance computer 3 determines that the commanded actions are safe, it initiates a complementary telegram via a path 9 to the field equipment 10, confirming the command from the interlocking functional computer 2. If the interlocking assurance computer 3 determines that the commanded actions are not safe, it initiates a negating telegram via path 9 to the field equipment, in which the field outputs are forced to their most restrictive safe state, for example not to move points or to light the most restrictive signal aspect.

The field equipment 10 compares the telegrams received from the interlocking functional computer 2 and interlocking assurance computer 3. If the telegrams are complementary, the field equipment can safely execute the actions commanded in the telegram. If the telegrams are different, or one of the telegrams is not received, the field equipment reverts its outputs to the most restrictive safe state.

In the first example, the interlocking functional computer and associated interlocking assurance computer arrangement ray be duplicated as shown by way of another interlocking functional computer 2*a* and associated interlocking assurance computer 3*a,* with associated paths 5*a,* 6*a,* 7*a,* 8*a* and 9*a* If a failure is detected in interlocking functional computer 2 and/or interlocking assurance computer 3, then operation is switched to interlocking functional computer 2*a* and interlocking assurance computer 3*a* via change over arrangements 11.

Referring to FIG. 2, in a second example, a central interlocking processor 1' also includes two computers, namely an interlocking functional computer 2' and an interlocking assurance computer 3' (which is configured as per interlocking assurance computer 3 of the first example) which receive telegrams reporting the status of the trackside equipment from the field equipment 10' via high speed serial communications path 4' and paths 6' and 5' respectively.

The interlocking functional computer 2' again processes route setting requests from the signalling control arrangement of the railway system and applies its data to determine whether or not to set the route, but includes three processor modules 12, 13, and 14 each of which operates on two diverse representations of the interlocking functional logic to produce complementary versions of an instruction telegram, which are supplied to a communications module 15 which votes on a two out of three basis as to which two complementary versions of an instruction telegram are to be sent to the field equipment 10" via a path 7' and high speed serial communications path 4'.

The interlocking assurance computer 3' monitors telegrams on path 4' via a path 16, and if a telegram or telegrams contravenes or contravene rules, it inhibits its action or their actions by issuing a negating telegram to the field equipment 10' via paths 9' and 4', so that the field outputs are forced to their most restrictive safe state. The interlocking assurance computer 3' may also impose a restriction on the actions of interlocking functional computer 2' via paths 9', 4' and 5' so that the computer 2' may not repeat an instruction which contravenes the rules. Such a restrictions may be allowed to expire after a given time and/or be allowed to be manually overridden.

The functions of the interlocking assurance computer 3' could be built in to the programmed functions of each of processor modules 12, 13 and 14 if desired.

The interlocking assurance computer 3' could be used to test the correct functionality of the interlocking functional computer 2' before the latter is installed (possibly without the computer 3') using a stricter set of rules than would be followed in practice.

What is claimed is:

1. An interlocking for a railway system, comprising:

functional computing means which commands route settings in the system in response to route setting requests; and assurance computing means coupled with the functional computing means, wherein the assurance computing means contains information concerning the signalling principles of the railway system and receives information concerning the state of the railway system and information concerning commands from the functional computing means and only allows a command from the functional computing means to be brought into effect if the current state of the railway system is such that it would be safe to do so.

2. An interlocking according to claim 1, including interface means, which interfaces with trackside equipment of the system, and a communication path between the interface means and the functional and assurance computing means.

3. An interlocking according to claim 1, wherein the functional and assurance computing means have different designs to reduce the risk of common mode failures.

4. An interlocking according to claim 1, wherein if a command is not allowed to be brought into effect, the assurance computing means causes the railway system to be put into a safe or more restrictive state.

5. An interlocking according to claim 1, wherein the assurance computing means issues a complementary command to allow a command from the functional computing means to be brought into effect if it is safe to do so.

6. An interlocking according to claim 1, wherein if a command from the functional computing means is not to be brought into effect, the assurance computing means issues a negating command for that purpose.

7. An interlocking according to claim 6, wherein the functional computing means issues each command in first and second complementary versions.

8. An interlocking according to claim l, wherein there is at least one additional functional computing means, the additional functional computing means being coupled with a respective additional assurance computing means and means for switching operation from one of the functional and assurance computing means to the additional functional and additional assurance computing means.

* * * * *